US010618680B2

(12) United States Patent
Hung

(10) Patent No.: US 10,618,680 B2
(45) Date of Patent: Apr. 14, 2020

(54) PLASTIC FILM SEALING AND PACKAGING DEVICE

(71) Applicant: Tzu-Chin Hung, Taipei (TW)

(72) Inventor: Tzu-Chin Hung, Taipei (TW)

( * ) Notice: Subject to any disclaimer, the term of this patent is extended or adjusted under 35 U.S.C. 154(b) by 353 days.

(21) Appl. No.: 15/486,563

(22) Filed: Apr. 13, 2017

(65) Prior Publication Data

US 2018/0273224 A1 Sep. 27, 2018

(30) Foreign Application Priority Data

Mar. 23, 2017 (TW) ..... 106204117 U

(51) Int. Cl.

| | |
|---|---|
| ***B65B 53/06*** | (2006.01) |
| ***B65B 11/08*** | (2006.01) |
| ***B65B 35/10*** | (2006.01) |
| ***B65B 41/16*** | (2006.01) |
| ***B65B 65/02*** | (2006.01) |
| ***B65B 9/02*** | (2006.01) |

(52) U.S. Cl.
CPC ..... *B65B 53/06* (2013.01); *B65B 9/026* (2013.01); *B65B 41/16* (2013.01)

(58) Field of Classification Search
CPC ..... B65B 41/16; B65B 9/026; B65B 53/06
USPC ..... 53/557, 553, 586
See application file for complete search history.

(56) References Cited

U.S. PATENT DOCUMENTS 3,589,091 A * 6/1971 Cloud ..... B65B 53/00 53/399
3,739,547 A * 6/1973 Brevko ..... B65B 9/026 53/553
5,067,312 A * 11/1991 Van Dijk ..... B65B 9/026 53/228
5,187,922 A * 2/1993 Mast ..... B65B 9/026 53/229
5,203,137 A * 4/1993 Tsukada ..... B29C 65/02 53/204
6,474,051 B1 * 11/2002 Hannen ..... B65B 9/026 53/556
9,260,211 B2 * 2/2016 Hung ..... B65B 11/10
(Continued)

FOREIGN PATENT DOCUMENTS

| | | |
|---|---|---|
| TW | 324370 | 1/1998 |
| TW | 471444 | 1/2002 |

*Primary Examiner* — Robert F Long
*Assistant Examiner* — Xavier A Madison
(74) *Attorney, Agent, or Firm* — Rosenberg, Klein & Lee

(57) ABSTRACT

A plastic film sealing and packaging device includes a chassis, a conveyance device for conveying articles-to-be-packaged, at least one pair of plastic film conveyance trays, at least one plastic film sealing mechanism and at least one heat-shrinking device. The conveyance device extends through front and rear ends of the chassis. The plastic film conveyance trays are set at two sides of the chassis to supply strap-like packaging plastic films. The plastic film sealing mechanism is arranged behind the plastic film conveyance trays to have packaging plastic films supplied from the plastic film conveyance trays sealed and combined as a combined film that is set horizontally set so that the articles-to-be-packaged conveyed by the conveyance device are allowed to contact the packaging plastic film to have the packaging plastic film wrapping around a closure site of the article-to-be-packaged. The package plastic film is then sealed by the plastic film sealing mechanism.

15 Claims, 12 Drawing Sheets

(56) References Cited

U.S. PATENT DOCUMENTS

| | | | | |
|---|---|---|---|---|
| 2011/0088354 | A1* | 4/2011 | Murgia Mendizabal | B65B 7/2885 53/399 |
| 2012/0240525 | A1* | 9/2012 | Summerford | B65B 53/02 53/442 |
| 2018/0305049 | A1* | 10/2018 | Wetsch | B65B 11/50 |

* cited by examiner

PLASTIC FILM SEALING AND PACKAGING DEVICE

BACKGROUND OF THE INVENTION

1. Field of the Invention

The present invention relates to a plastic film sealing and packaging device, and more particularly to a packaging device that is applicable to an article to be package that comprises a cover for closure and allows a packaging plastic film to wrap around the closure of the article to be packaged and to have the packaging plastic film fixed and sealed and forming at least two sealing lines.

2. The Related Arts

Packaging plastic films have been widely used in applications for packing or packaging different packaged articles, such as packaged instant foodstuffs contained in containers of various different outside configurations and having an opening closed by a cover, including meal boxes, noodles, medicated diets, salads, and so on. Since the packaged articles, such as meal boxes or package containers that contain food therein, are of diversified shape and size, known plastic film enclosing, sealing, and packaging devices, in packaging and sealing a sealed portion of the container and the cover with a heat-shrinkage film, must conduct a heat shrinkage operation to have the packaged article enclosed and sealed in a manner of having a heat-shrinkage film completely or partly covering the packaged article. Such a known plastic film enclosing, sealing, and packaging device needs to consume a large amount of package films so that the packaging cost is increased and environmental protection is also a concern for a large amount of waste packaging material will be generated. In addition, when a consumer or a user opens the packaged article, the heat shrinkage film, either for complete coverage or part coverage, generates a tough coverage, which causes troubles for the consumer or user to tear open or to break the heat shrinkage film of the packaged article. An additional tear line forming machine must be used to imprint or perforate a tear line on the package film. This leads to an increase of both operation time and cost in packaging an article. This is definitely an issue that must be dissolved in packaging a cover-included container.

Another problem of the conventional heat shrinkage film enclosing machine in enclosing an packaged article including a cover-included container with a heat shrinkage film is that the shape and size of the packaged article may vary arbitrary and thus, it often needs to change parts of the heat shrinkage film enclosing machine to install multiple sets of molds or template plates to suit different sizes and shapes of the articles to be packaged so that the articles to be packaged can be positioned to allow the machine to fit heat shrinkage film thereto. An example is disclosed in Taiwan Patent No. 324370, which teaches installing multiple template plates (16) on a conveyor belt (15) to allow an article to be packaged, such as meal box (22), to fit into a plastic film (30) for sealing and packaged. Such a typical sealing machine as disclosed in the patent document has a complicated structure of the machine and require a high cost, making it not economic to sealing and packaging of articles. In addition, the template plates (16) that are installed on the conveyor belt (15) must be changed according to the shape and size of the articles to be packaged and re-installed on the conveyor belt (15). This is time-consuming and labor-consuming and would greatly increase the cost of sealing. Further, when the size of the article to be packaged, such as meal box (22), is large, it is hard to install the template plate (16) on the conveyor belt (15) and thus the embodiment is difficult.

In addition, Taiwan Patent No. 471444 teaches a plastic film fitting machine that comprises a rotary tray provided on a conveyor belt for accommodating an article to be packaged.

SUMMARY OF THE INVENTION

The primary object of the present invention is to provide a plastic film sealing and packaging device, which overcomes the drawbacks of the known plastic film fitting machine or sealing machine that a great waste of plastic film may be caused in packaging cover-included containers for containing meals, noodles, medicated diets, and salads, that it is hard to remove the packaging plastic film, and that molds or templates that suit the size and shape of articles to be packaged must be provided on a conveyor belt that conveys the articles to be packaged and thus increase the packaging cost, and the structure is complicated and operation is difficult, making it adverse to industrial utilization.

Thus, the present invention provides a plastic film sealing and packaging device, which comprises:

a chassis;

at least one conveyance device arranged in and extending through front and rear ends of the chassis for conveying a plurality of articles-to-be-packaged;

at least one pair of plastic film conveyance trays respectively set at two sides of the chassis, the plastic film conveyance trays each receiving a strap-like packaging plastic film wrapped thereon in order to supply, in a direction from outside to inside, the strap-like packaging plastic film;

at least one plastic film sealing mechanism arranged behind the plastic film conveyance trays to seal and combine the strap-like packaging plastic films supplied from the plastic film conveyance trays as a combined packaging plastic film that is set horizontally on a forward path of the conveyance device and formed with a first sealing line, wherein one of the articles-to-be-packaged conveyed forward by the conveyance device is allowed to get contact with the combined packaging plastic film that horizontally set on the forward path of the conveyance device to allow the combined packaging plastic film to wrap around a closure site of the article-to-be-packaged, the plastic film sealing mechanism being operable to provide sealing, fixing, and cutting operations on the combined packaging plastic film wrapping around the article-to-be-packaged to have the combined packaging plastic film fixedly wrapped around the closure site of the article-to-be-packaged and forming a second sealing line on the combined packaging plastic film; and at least one heat-shrinking device, which is arranged behind the plastic film sealing mechanism to subject the combined packaging plastic film wrapping around the article-to-be-packaged to heating and shrinking packaging so as to have the combined packaging plastic film thermally shrunk onto the closure site of the articles-to-be-packaged.

In the above plastic film sealing and packaging device, the articles-to-be-packaged conveyed by the conveyance device are containers including covers.

In the above plastic film sealing and packaging device, the chassis is provided with a plurality of guide pillars behind the plastic film conveyance trays to allow the packaging plastic films supplied from the plastic film conveyance trays to extend and wrap around the guide pillars and guided by the guide pillars to have the packaging plastic films supplied in a direction from the outside to the inside.

In the above plastic film sealing and packaging device, the plastic film sealing mechanism comprises:

at least one mounting plate, which is mounted to the chassis, the mounting plate comprising at least one rail mounted to a bottom thereof and set horizontally;

at least one sealing drive device, which is arranged between a top and the bottom of the mounting plate; and at least one pair of sealing blades, which have tops respectively mounted to the rail on the bottom of the mounting plate, the sealing blades being coupled to the sealing drive device, such that the sealing blades are controlled and driven by the sealing drive device to move along a path of the rail for simultaneously moved inward toward each other for closing and thus carrying out operations for combining the packaging plastic films supplied from the plastic film conveyance trays and sealing and combination or, after the packaging plastic films have been sealed, the sealing blades are driven by the sealing drive device to move outward along the path of the rail to return to the original position.

In the above plastic film sealing and packaging device, the sealing drive device of the plastic film sealing mechanism comprises:

at least one driving pneumatic cylinder, which is mounted to the top of the mounting plate, the driving pneumatic cylinder comprising an extendible/retractable operation rod;

at least one connection plate and a first connection bar, the connection plate having two ends respectively and pivotally connected to an end of the operation rod of the driving pneumatic cylinder and an end of the first connection bar, the connection plate being pivotally connected, at a middle thereof, with the bottom of the mounting plate, an opposite end of the first connection bar being pivotally connected to the top of one of the sealing blades to allow for extension/retraction of the operation rod of the driving pneumatic cylinder and allow the connection plate and the first connection bar to drive the sealing blades to get inward toward each other or move outward to the original position by following the path of the rail; and at least one second connection bar, which has two ends respectively connected to an opposite end of the connection plate and the top of another one of the sealing blades so that the connection plate and the first connection bar are allowed to drive the second connection bar to extend/retract to drive the sealing blades to get inward toward each other or move outward to the original position by following the path of the rail.

In the above plastic film sealing and packaging device, the first sealing line and the second sealing line that are formed by the plastic film sealing mechanism on the combined packaging plastic film that wraps around the article-to-be-packaged are set at locations that are opposite to each other and spaced from each other by 180 degrees.

In the above plastic film sealing and packaging device, the chassis is provided with at least one press-down and holding device behind the plastic film sealing mechanism, the press-down and holding device comprising an extendible/retractable operation rod, the operation rod having an end coupled to at least one pressing and holding section, so that when the plastic film sealing mechanism carries out a sealing operation on the packaging plastic film to form the second sealing line, the operation rod extends downward to drive the pressing and holding section to press down and contact a top of the article-to-be-packaged.

In the above plastic film sealing and packaging device, the press-down and holding device comprises a pneumatic cylinder.

The present invention also provides a plastic film sealing and packaging device, which comprises:

a chassis;

at least one conveyance device arranged in and extending through front and rear ends of the chassis for conveying a plurality of articles-to-be-packaged;

at least one pair of plastic film conveyance trays respectively set at two sides of the chassis, the plastic film conveyance trays each receiving a strap-like packaging plastic film wrapped thereon in order to supply, in a direction from outside to inside, the strap-like packaging plastic film;

at least one plastic film sealing line shifting device, which is arranged on at least one side of the chassis behind the plastic film conveyance trays to provide a function of pulling the packaging plastic films outward and backward by a predetermined distance;

at least one plastic film sealing mechanism arranged behind the plastic film conveyance trays to seal and combine the strap-like packaging plastic films supplied from the plastic film conveyance trays as a combined packaging plastic film that is set horizontally on a forward path of the conveyance device and formed with a first sealing line, wherein the plastic film sealing line shifting device is operable to pull the combined packaging plastic film outward and backward to have the first sealing line shifting, in position, outward and backward by a predetermined distance and wherein one of the articles-to-be-packaged conveyed forward by the conveyance device is allowed to get contact with the combined packaging plastic film that horizontally set on the forward path of the conveyance device to allow the combined packaging plastic film to wrap around a closure site of the article-to-be-packaged, the plastic film sealing mechanism being operable to provide sealing, fixing, and cutting operations on the combined packaging plastic film wrapping around the article-to-be-packaged to have the combined packaging plastic film fixedly wrapped around the closure site of the article-to-be-packaged and forming a second sealing line on the combined packaging plastic film, a breakable and tearable block being formed in the packaging plastic film between the second sealing line and the first sealing line; and at least one heat-shrinking device, which is arranged behind the plastic film sealing mechanism to subject the combined packaging plastic film wrapping around the article-to-be-packaged to heating and shrinking packaging so as to have the combined packaging plastic film thermally shrunk onto the closure site of the articles-to-be-packaged.

In the above plastic film sealing and packaging device, the first sealing line and the second sealing line that are formed by the plastic film sealing mechanism on the combined packaging plastic film that wraps around the article-to-be-packaged are set at locations that are opposite to each other and spaced from each other by 180 degrees.

In the above plastic film sealing and packaging device, the plastic film sealing line shifting device comprises:

at least one drive motor and a front retention roller, the drive motor being arranged on the chassis in front of the packaging plastic films, the front retention roller being coupled to a rotation spindle of the drive motor to be driven and rotated by the drive motor, the front retention roller being in contact with a front surface of the packaging plastic film; and at least one pushing pneumatic cylinder and a rear retention roller, the pushing pneumatic cylinder being arranged on the chassis behind the packaging plastic films, the pushing pneumatic cylinder having an operation rod coupled to the rear retention roller, so that the operation rod of the pushing pneumatic cylinder drives the rear retention roller forward to collectively clamp the front and rear surfaces of the packaging plastic film with the front retention roller, the drive motor driving and rotating the front retention roller to rotate so as to pull the packaging plastic film outward and backward by a predetermined distance to also make the first sealing line of the packaging plastic film pulled outward and backward by a predetermined distance.

In the above plastic film sealing and packaging device, the heat-shrinking device comprises:

at least one pair of hot airflow supply devices respectively mounted on the chassis at locations corresponding to two sides of the conveyance device behind the plastic film sealing mechanism, the hot airflow supply devices being each provided with an airflow outlet that supplies a hot airflow, the two hot airflow supply devices being provided therebetween with a heating passageway, the airflow outlets being arranged to face inward to supply the hot airflows to the heating passageway in order to carry out a heating and heat shrinking operation on the packaging plastic film wrapping around the article-to-be-packaged carried by the conveyance device; and at least one top cover, which is mounted above the hot airflow supply devices to cover the heating passageway between the hot airflow supply devices.

In the above plastic film sealing and packaging device, the chassis is provided with a controller, which controls operations of the conveyance device, the plastic film sealing mechanism, and the heat-shrinking device.

The efficacy of the plastic film sealing and packaging device of the present invention is that the strap-like packaging plastic films are first sealed and combined together by the plastic film sealing mechanism as a combined film that is horizontally set on a path along which the conveyance device convey articles-to-be-packaged. The kinetic energy that the conveyance device moves the articles-to-be-packaged forward causes the articles-to-be-packaged to get into contact with the packaging plastic film, so as to have the packaging plastic film wrapping around a closure site of the articles-to-be-packaged, whereby the use of the present invention is not constrained to the shape and size of the articles-to-be-packaged and is operable to seal and package all articles-to-be-packaged and thus, no need to install any mold or template that suit the size and shape of the articles-to-be-packaged on the conveyance device as required by the prior art thereby greatly improving the application of the present invention and saving packaging cost for articles-to-be-packaged that include covers. Further, the present invention uses a plastic film sealing line shifting device to provide a function of pulling the first sealing line of the packaging plastic film outward and backward by a predetermined distance to make the final position of the first sealing line and the second sealing line close to and set to a desired location and to provide a breakable and tearable block on the packaging plastic film between the first sealing line and the second sealing line so that there is no need to provide any tearable lines imprinted on the packaging plastic film and a user is allowed to tear the breakable and tearable block along the first sealing line and the second sealing line in unpacking the articles-to-be-packaged so as to efficiently remove the entire packaging plastic film wrapping around the closure site of the articles-to-be-packaged to provide the user with an effort-saving and easy way of removing the packaging plastic film to improve the industrial use value and economic efficacy of the entire device.

BRIEF DESCRIPTION OF THE DRAWINGS

The present invention will be apparent to those skilled in the art by reading the following description of preferred embodiments thereof, with reference to the attached drawings, wherein.

DETAILED DESCRIPTION OF THE PREFERRED EMBODIMENTS

Figure 1:
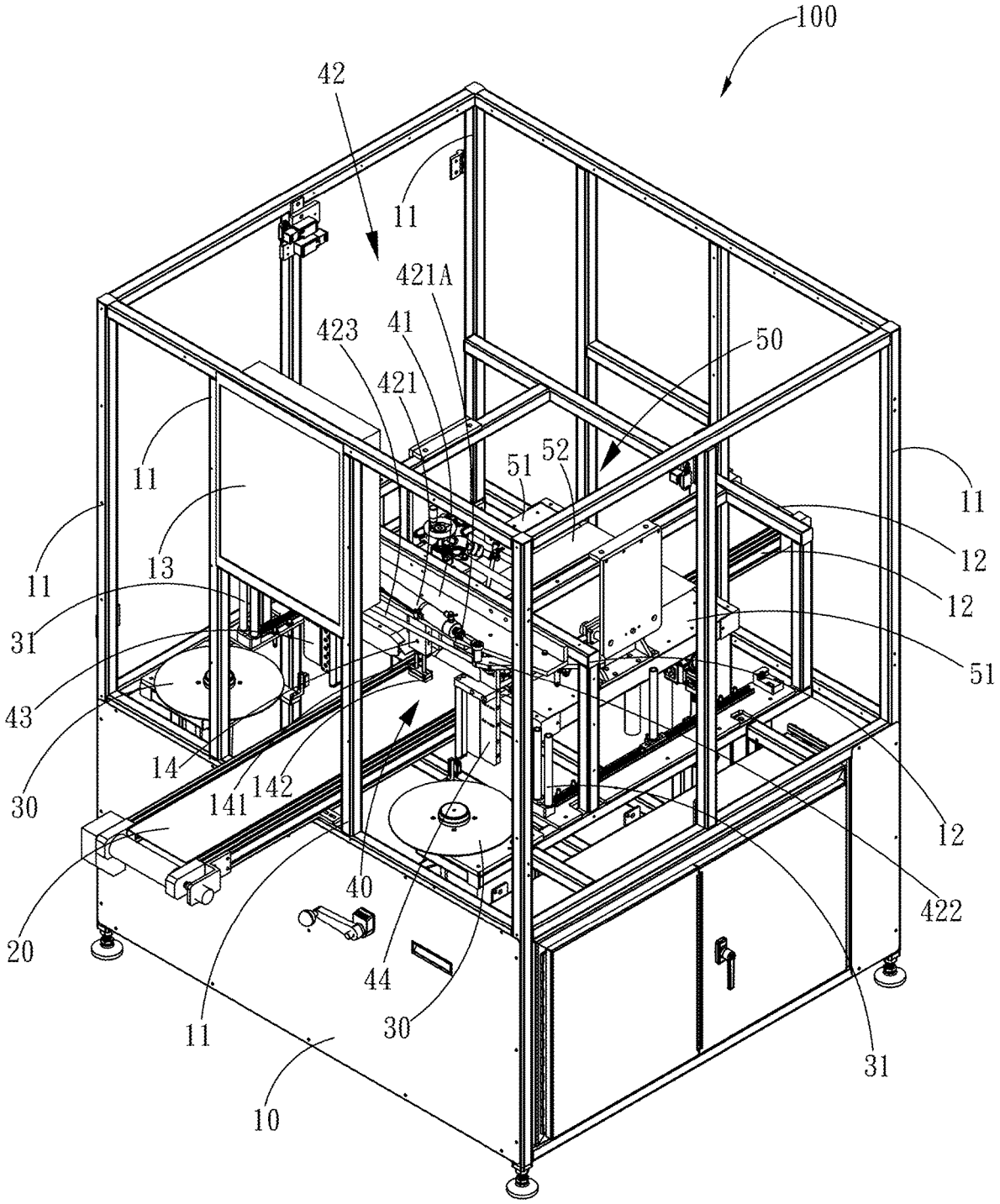
FIG. 1 is a perspective view showing a plastic film sealing and packaging device according to a first embodiment of the present invention.

Referring to FIGS. 1, 2, 3, and 4, the present invention provides a plastic film sealing and packaging device 100. As a first embodiment of the present invention, the plastic film sealing and packaging device 100 generally comprises a chassis 10. The chassis 10 is provided, mounted thereon, with a plurality of primary support frames 11 and a plurality of auxiliary support frames 12. One pair of primary support frames 11 of the chassis 10 are provided with a controller 13 mounted thereto.

Figure 4:
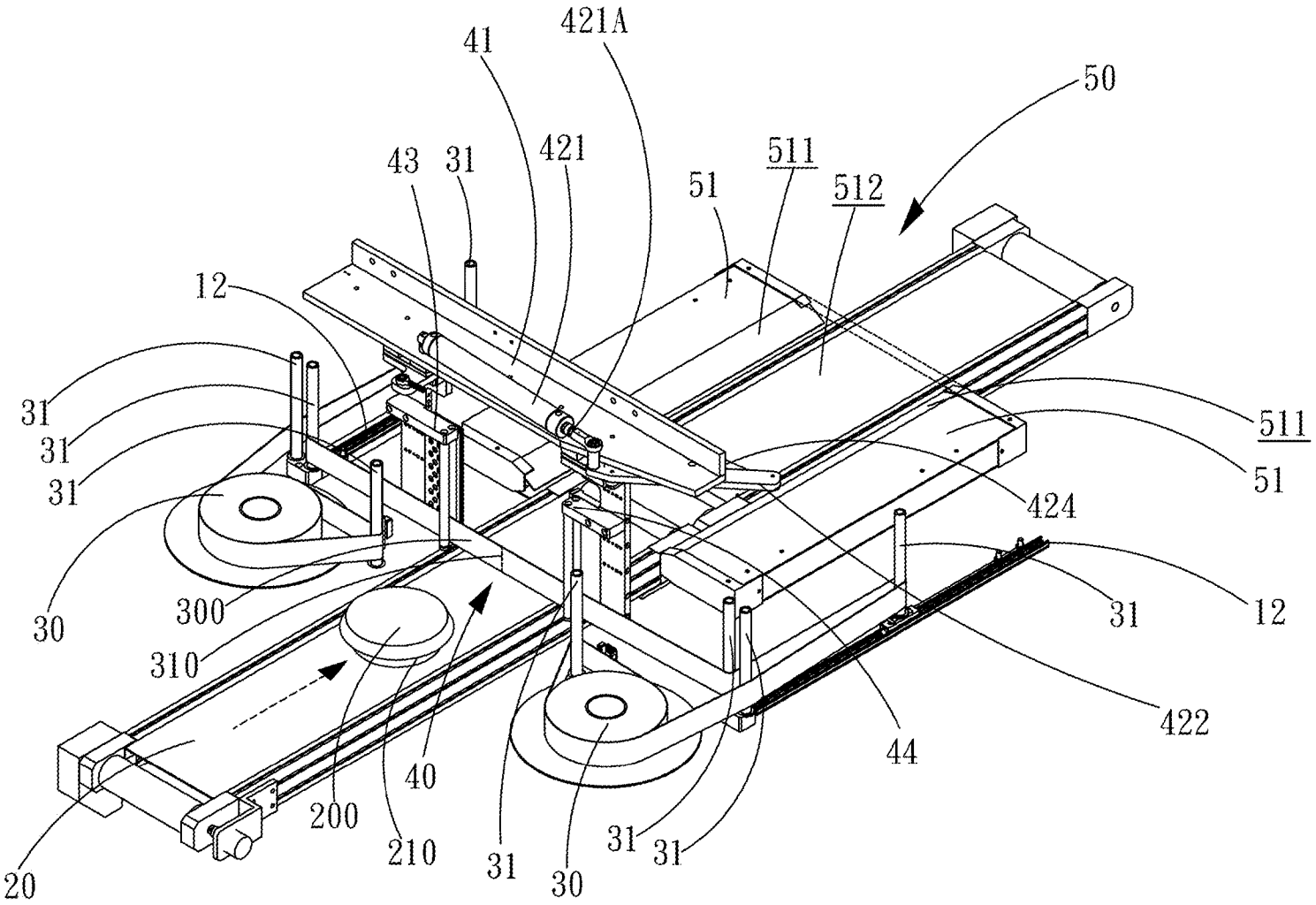
FIG. 4 is a partial enlarged view similar to FIG. 3 showing a condition where the plastic film sealing mechanism of the present invention forms a first sealing line on the packaging plastic films supplied from the plastic film conveyance trays.

At least one conveyance device 20 is arranged in and extends through front and rear sides of the chassis 10 to convey a plurality of articles-to-be-packaged 200 (as shown in FIG. 4). The articles-to-be-packaged 200 are not limited to any specific shape and size and in the first embodiment of the present invention, a circular meal box including a cover is provided as an example for illustration.

at least one pair of plastic film conveyance trays 30 are respectively arranged at two sides of the chassis 10. The plastic film conveyance trays 30 are provided with strap-like packaging plastic films 300 arranged therein and wound thereon in the form of a roll. The chassis 10 is provided with a plurality of guide pillars 31 located behind the plastic film conveyance trays 30 to allow the packaging plastic films 300 that are unwound from the plastic film conveyance trays 30 to wrap around and among each of the guide pillars 31 so as to be guided by the guide pillars 31 to supply the strap-like packaging plastic films 300 in a manner of being fed in a direction from outside to inside.

Figure 2:
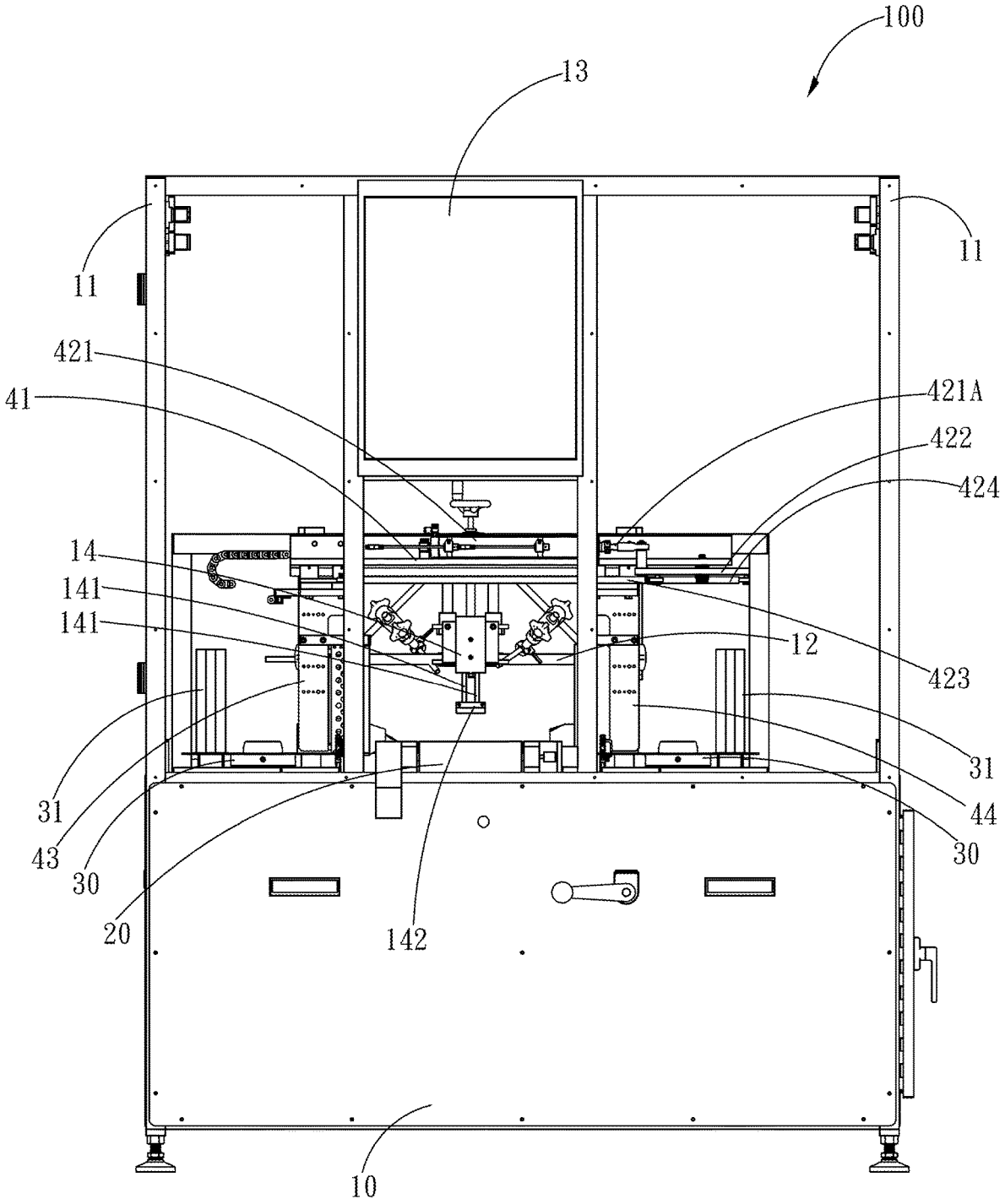
FIG. 2 is a front view of FIG. 1.

At least one plastic film sealing mechanism 40 is arranged at the rear end of the plastic film conveyance trays 30. The plastic film sealing mechanism 40 is not limited to any specific type and comprises, as an illustrative example in the first embodiment of the present invention, at least one mounting plate 41, at least one sealing drive device 42, and at least one pair of sealing blades 43, 44, wherein the mounting plate 41 is coupled to one of the auxiliary support frames 12 provided on the chassis 10 and the mounting plate 41 is provided, on a bottom thereof, at least one rail 411 (as shown in FIG. 2) arranged horizontally.

The sealing drive device 42 is arranged between top and bottom of the mounting plate 41. The sealing drive device 42 is not limited to any specific type and comprises, as an illustrative example in the present invention, at least one 421, at least one connection plate 422 and a first connection bar 423, and at least one second connection bar 424, wherein the driving pneumatic cylinder 421 is mounted on the top of the mounting plate 41 and the driving pneumatic cylinder 421 comprises an extendible/retractable operation rod 421A.

The connection plate 422 has two ends respectively and pivotally coupled to an end of the operation rod 421A of the driving pneumatic cylinder 421 and an end of the first connection bar 423. The connection plate 422 is pivotally connected, at a middle thereof, to the bottom of the mounting plate 41. An opposite end of the first connection bar 423 is pivotally connected to a top of the sealing blade 43. Two ends of the second connection bar 424 are respectively connected to an end of the connection plate 422 and a top of the sealing blade 44.

The sealing blades 43, 44 are provided, as an example of the present invention, as electrically heating type sealing blades and have functions of sealing, fixing, and cutting the packaging plastic film 300 through electrical heating. The sealing blades 43, 44 have tops that are respectively mounted to the rail 411 provided on the bottom of the mounting plate 41 so that through extension/retraction of the operation rod of the driving pneumatic cylinder, the connection plate 422 and the first connection bar 423 are driven to cause the sealing blade 43 to move along a path of the rail 411 to move inward for approaching or to move outward for returning, and through the movement of the connection plate 422 and the first connection bar 423, the second connection bar 424 is caused to extend or retract so as to cause the sealing blade 44 to move along a path of the rail 411 to move inward for approaching or to move outward for returning.

Figure 3:
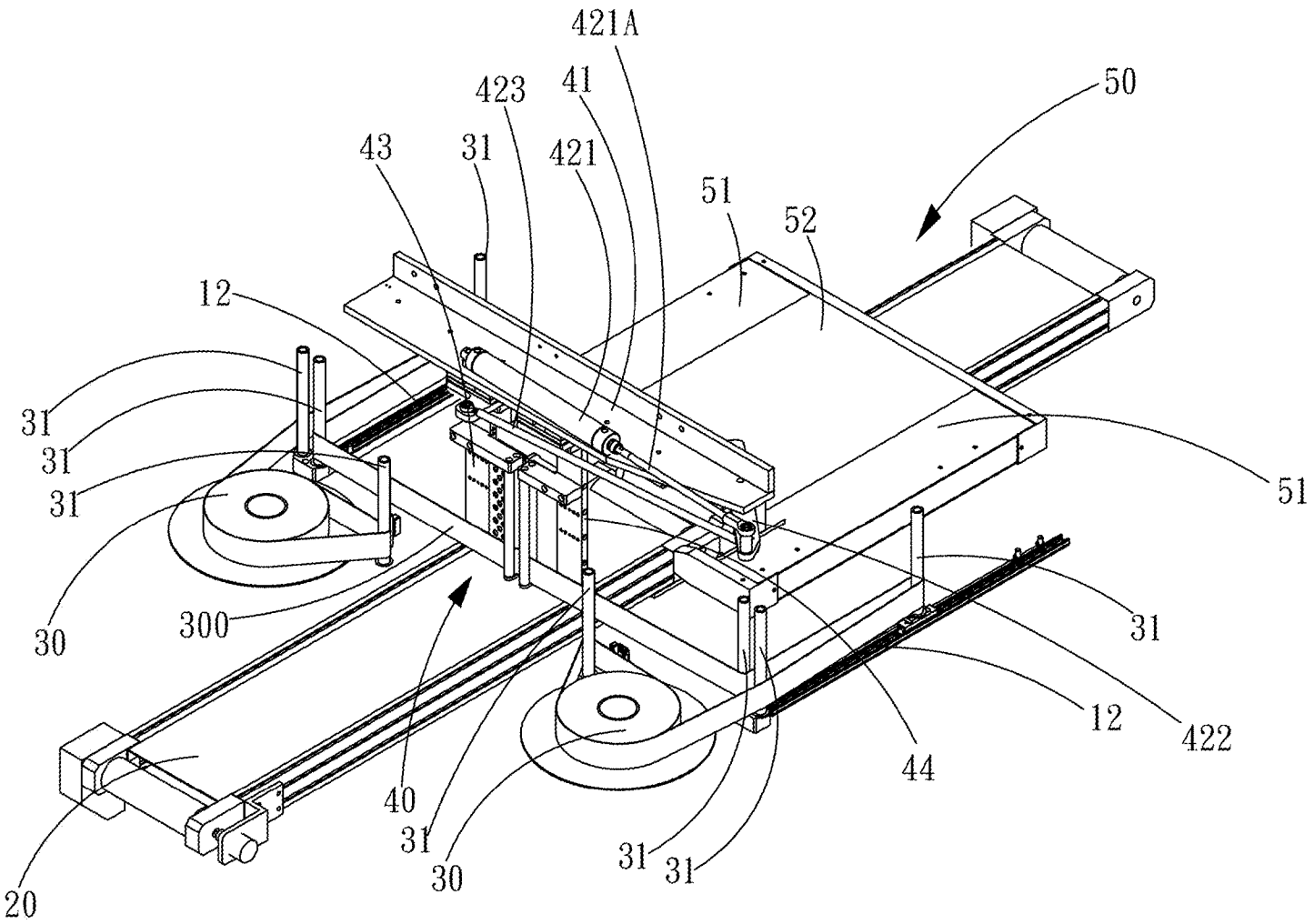
FIG. 3 is a partial enlarged view showing a condition where a plastic film sealing mechanism according to the present invention conducts sealing and combination of packaging plastic films supplied from plastic film conveyance trays.
Figure 5:
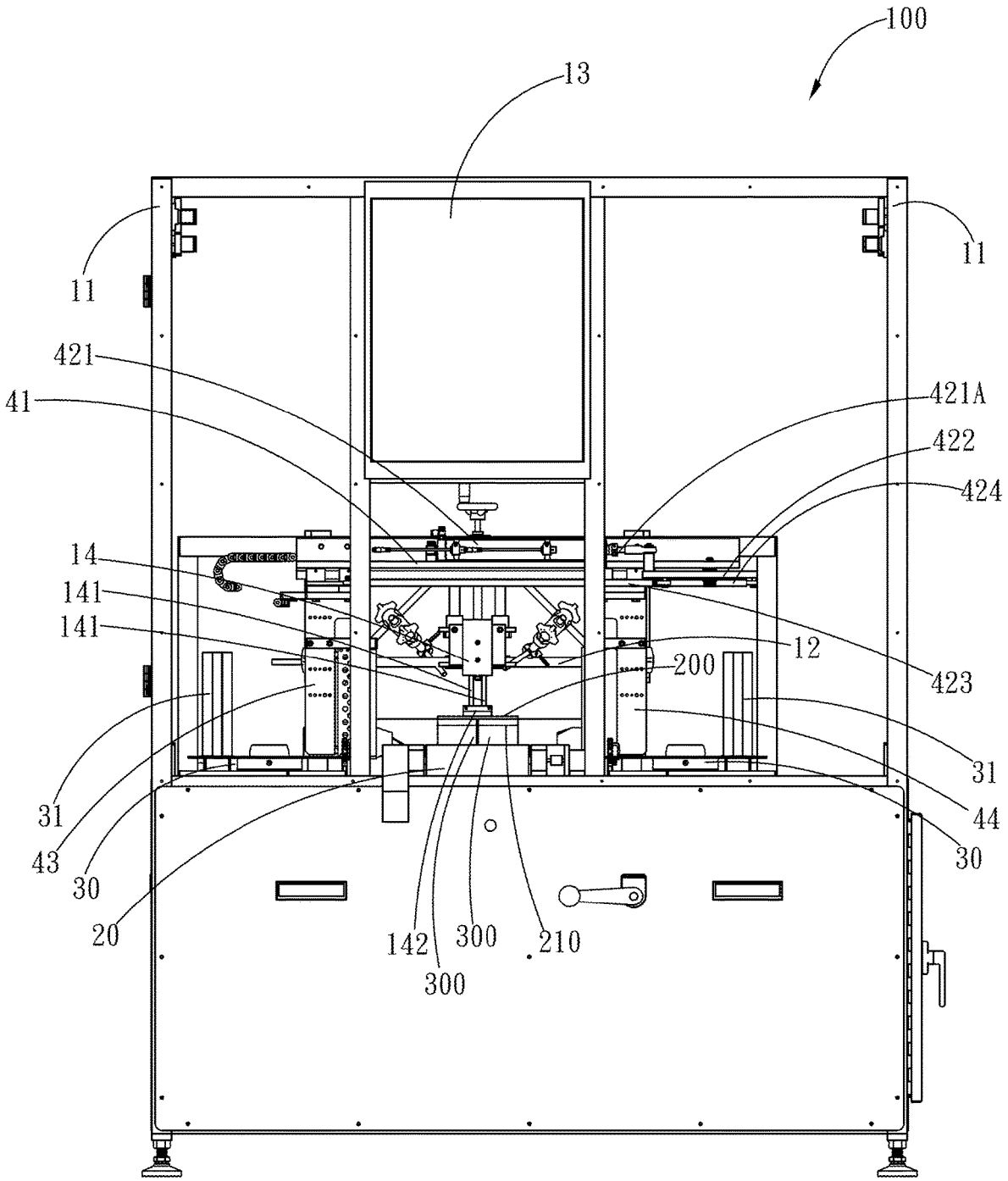
FIG. 5 is a front view similar to FIG. 2, showing a condition where an article-to-be-packaged gets into contact with the packaging plastic film to allow the packaging plastic film to wrap around the article-to-be-packaged.
Figure 6:
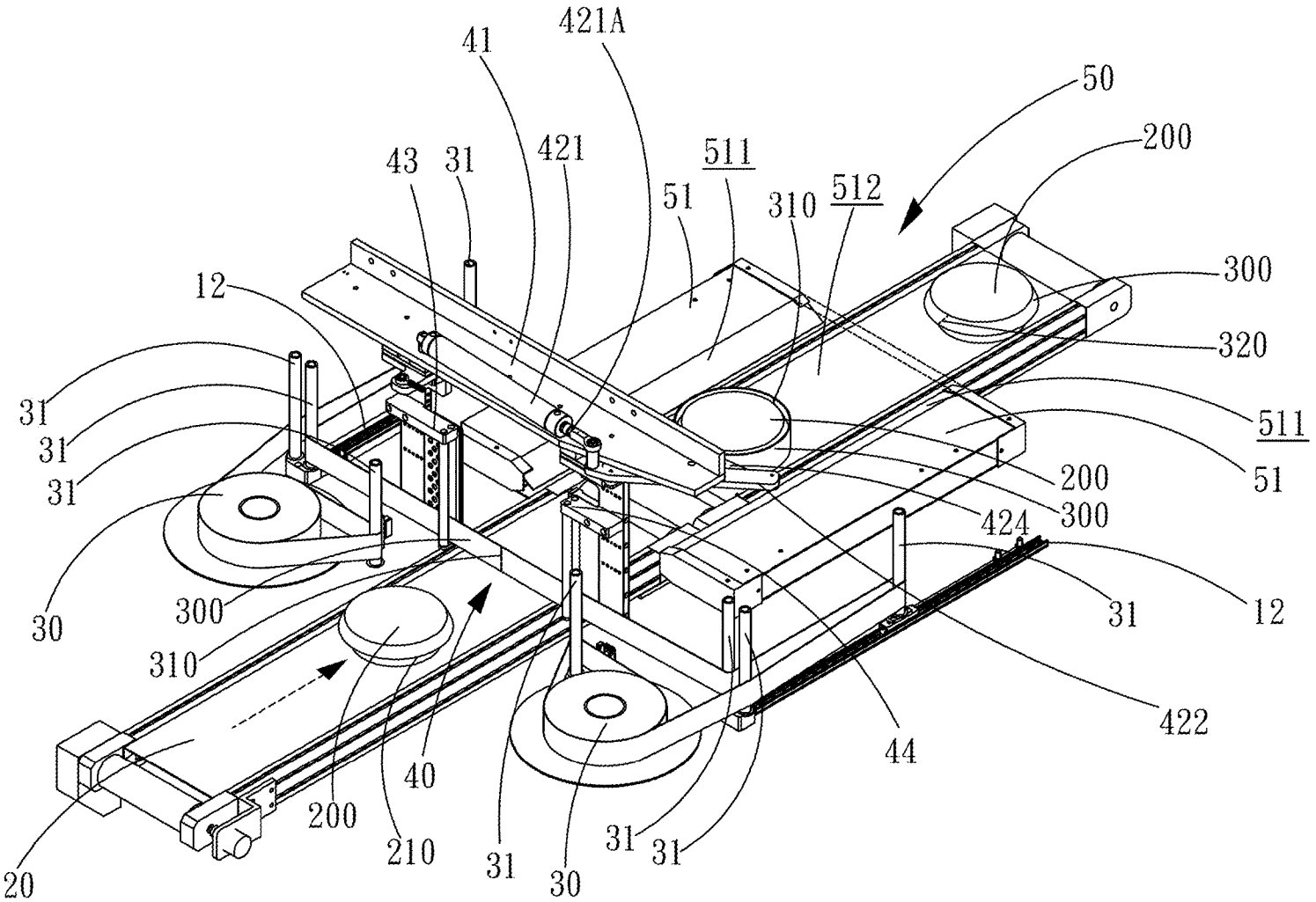
FIG. 6 is a partial enlarged view illustrating a condition where the plastic film sealing mechanism of the present invention conducts sealing on the packaging plastic film wrapping around the articles-to-be-packaged to for a second sealing line.
Figure 7:
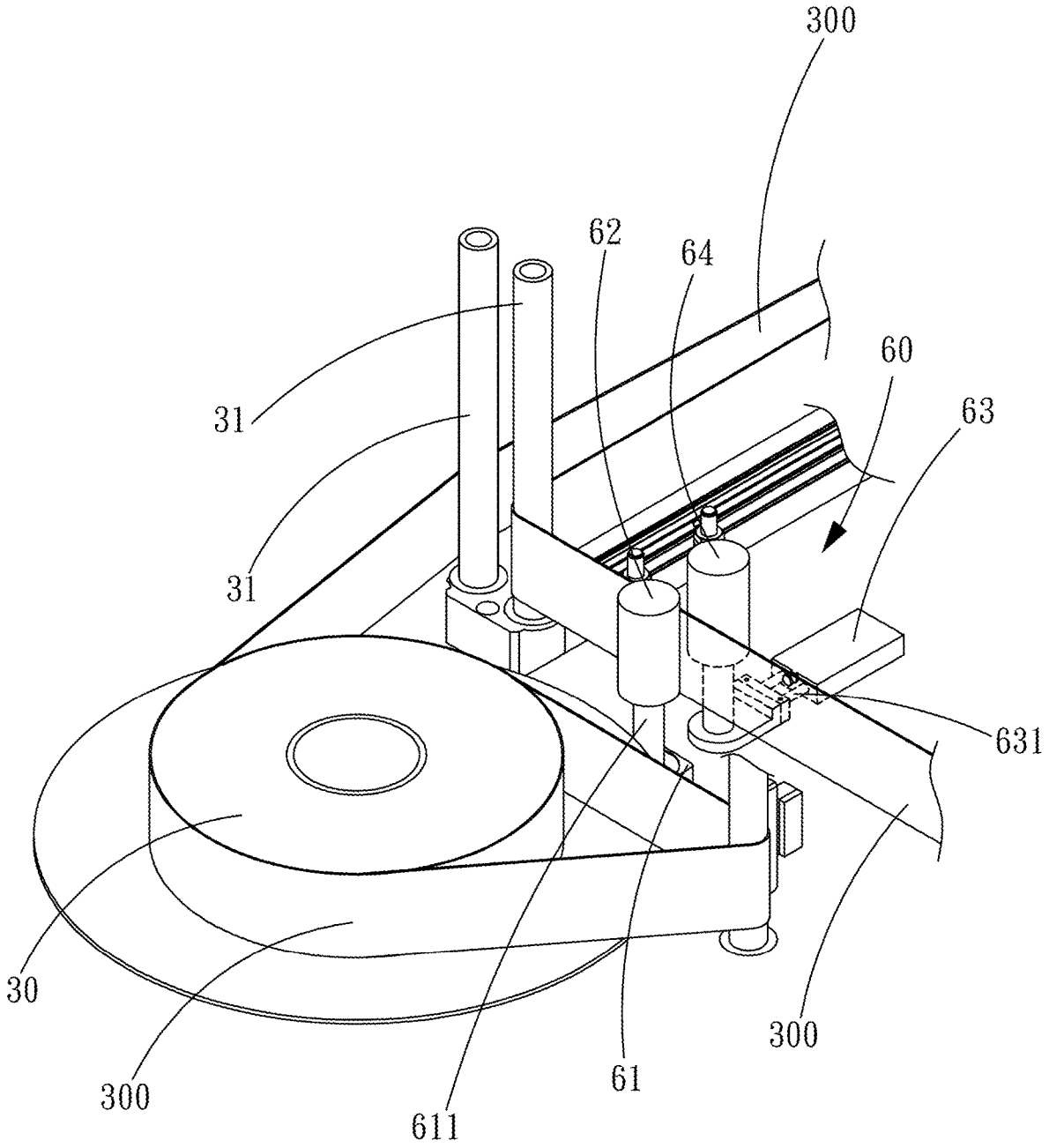
FIG. 7 shows a second embodiment of the plastic film sealing and packaging device according to the present invention.
Figure 8:
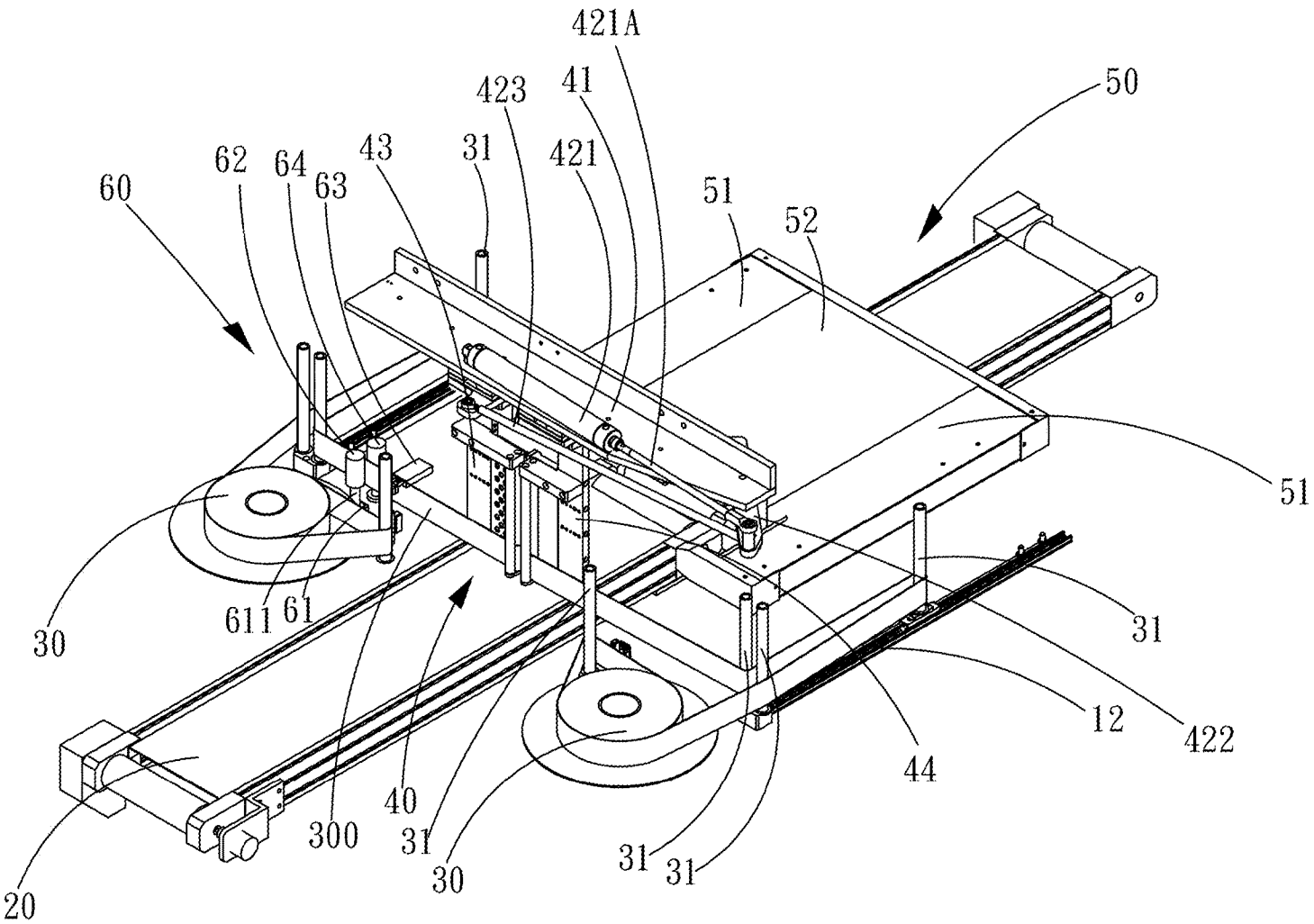
FIG. 8 is a partial enlarged view showing a condition where a plastic film sealing mechanism according to the embodiment of FIG. 7 conducts sealing and combination of packaging plastic films supplied from plastic film conveyance trays.

Referring to FIGS. 5 and 6, through the above-described operation of the two sealing blades 43, 44 of the plastic film sealing mechanism 40 moving inward for approaching and closing, the strap-like packaging plastic films 300 supplied from the two plastic film conveyance trays 30 are first sealed and combined together as one piece (as shown in FIG. 3), and then, the sealing blades 43, 44 move outward for returning the original positions to allow the packaging plastic film 300 to be set horizontally on a forward conveyance path of the conveyance device 20 and forming a first sealing line 310 (as shown in FIG. 4), so that an article-to-be-packaged 200 that is conveyed forward by the conveyance device 20 may get contact engagement with the strap-like packaging plastic films 300 that are combined together and set horizontally on the conveyance path of the conveyance device 20 to allow the packaging plastic film 300 to wrap around a closure site 210 of the articles-to-be-packaged 200 (as shown in FIG. 5), and subsequently, the two sealing blades 43, 44 of the plastic film sealing mechanism 40 are moved inward and closed again to provide sealing, fixing, and cutting operations to the packaging plastic film 300 that wraps around the articles-to-be-packaged 300 and making the packaging plastic film 300 fixed to and wrapping around the closure site 210 of the articles-to-be-packaged 200 and forming a second sealing line 320 on the packaging plastic film 300 (as shown in FIG. 6). The two sealing blades 43, 44 are then moved backward to return to the original positions. The packaging plastic film 300 that has been cut off and horizontally set on the forward path of the conveyance device 20 also form, at the same time, another first sealing line 310 to allow a next one of the articles-to-be-packaged 200 to get contacting and wrapped and sealed in the same way. The packaging plastic film 300 that is fixed to and wraps around the article-to-be-packaged 200 is provided such that the first sealing line 310 and the second sealing line 320, in the first embodiment of the present invention, are set at opposite positions that are separate from each other by 180 degrees, as shown in FIG. 6.

The chassis 10 is provided with at least one press-down and holding device 14 mounted to the auxiliary support frame 12 that is located behind the plastic film sealing mechanism 40. The press-down and holding device 14 is shown, as an example in the present invention, as a pneumatic cylinder and the press-down and holding device 14 comprises an extendible/retractable operation rod 141. The operation rod 141 has an end coupled to at least one pressing and holding section 142, so that when the plastic film sealing mechanism 40 is operated to conduct sealing of the packaging plastic film 300 wrapping around the article-to-be-packaged 200 to form the second sealing line 320, the operation rod 141 extends outward to drive the pressing and holding section 142 to press down onto a top of the article-to-be-packaged 200, allowing the packaging plastic film 300 to be accurately positioned and sealing around the closure site 210 of the article-to-be-packaged 200.

At least one heat-shrinking device 50 is arranged at a rear side of the plastic film sealing mechanism 40 to conduct heat shrinking and packaging of the strap-like packaging plastic film 300 wrapping around the articles-to-be-packaged 200 so as to have the packaging plastic film 300 thermally shrunk and packed around the closure site 210 of the articles-to-be-packaged 200. The heat-shrinking device 50 is not limited to any specific type and comprises, as an example in the present invention, at least one pair of hot airflow supply devices 51 and a top cover 52 (as shown in FIG. 3), wherein the two hot airflow supply devices 51 are respectively mounted to the chassis 10 at locations of two sides of the conveyance device 20 behind the plastic film sealing mechanism 40. The hot airflow supply devices 51 are provided with an airflow outlet 511, which provides hot airflow, and the two hot airflow supply devices 51 are provided therebetween with a heating passageway 512 (as shown in FIGS. 4 and 6). The airflow outlets 511 of the two hot airflow supply devices 51 are set to each facing inwardly to supply hot airflow toward the heating passageway 512 so as to carry out a heating and heat-shrinking operation on the packaging plastic film 300 that is wrapped around the article-to-be-packaged 200 and has been sealed by the plastic film sealing mechanism 40 and formed with the first sealing line 310 and the second sealing line 320 to move, with the conveyance device 20, through the heating passageway 52 so that the packaging plastic film 300 of the article-to-be-packaged 200 is thermally shrunk and thus packages the closure site of the articles-to-be-packaged 200. The top cover 52 is mounted above the two hot airflow supply devices 51 to cover and house the heating passageway 512 between the hot airflow supply devices 51.

All the above-described operations of the press-down and holding device 14, the conveyance device 20, the plastic film sealing mechanism 40, and the heat-shrinking device 50 are controlled by the controller 13 of the chassis 10.

Figure 9:
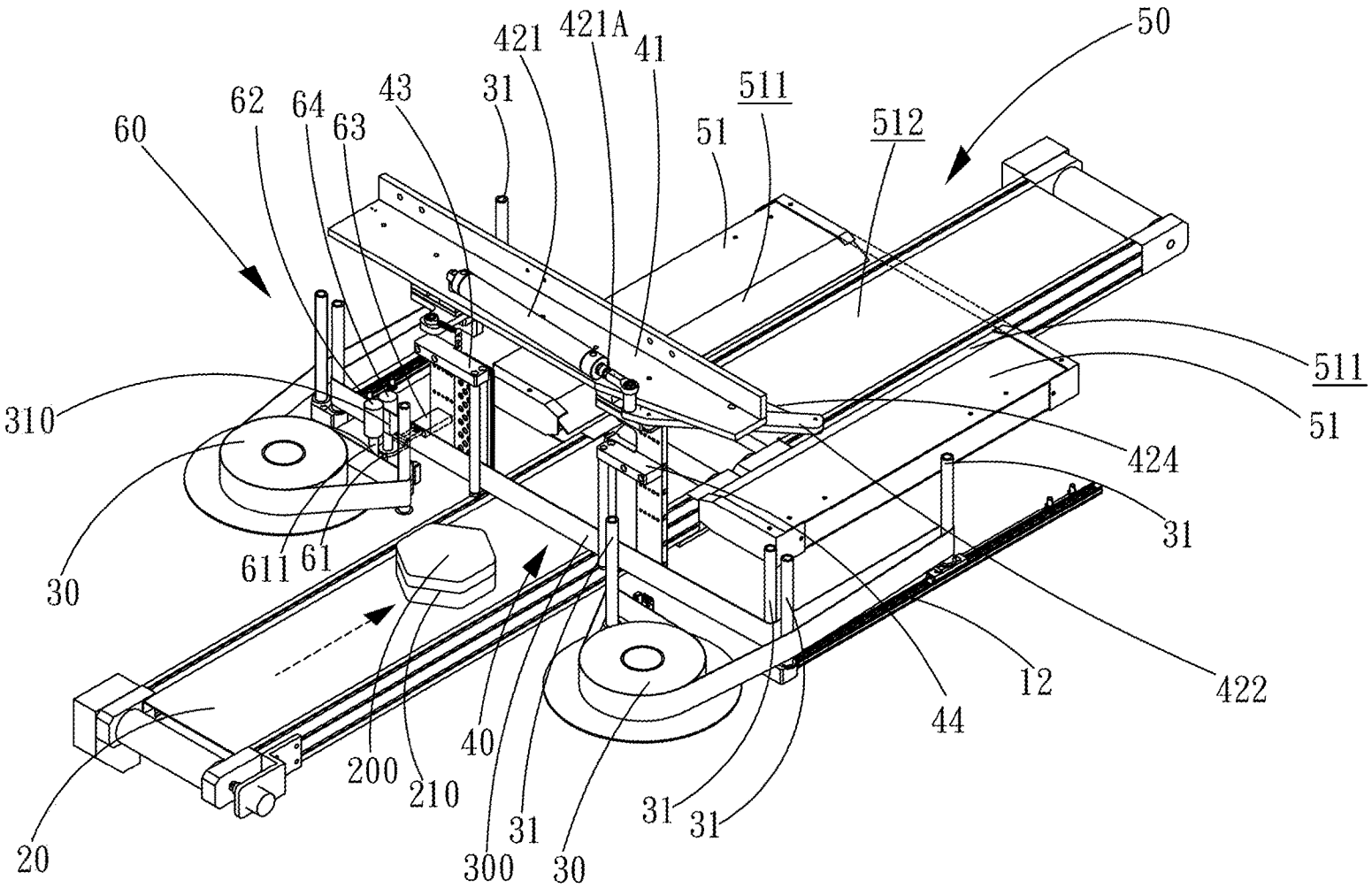
FIG. 9 is a partial enlarged view showing a condition where a plastic film sealing line shifting device according to the embodiment of FIG. 7 pulls the packaging plastic film outwards and backwards by a predetermined distance in order to adjust the location of a first sealing line.
Figure 10:
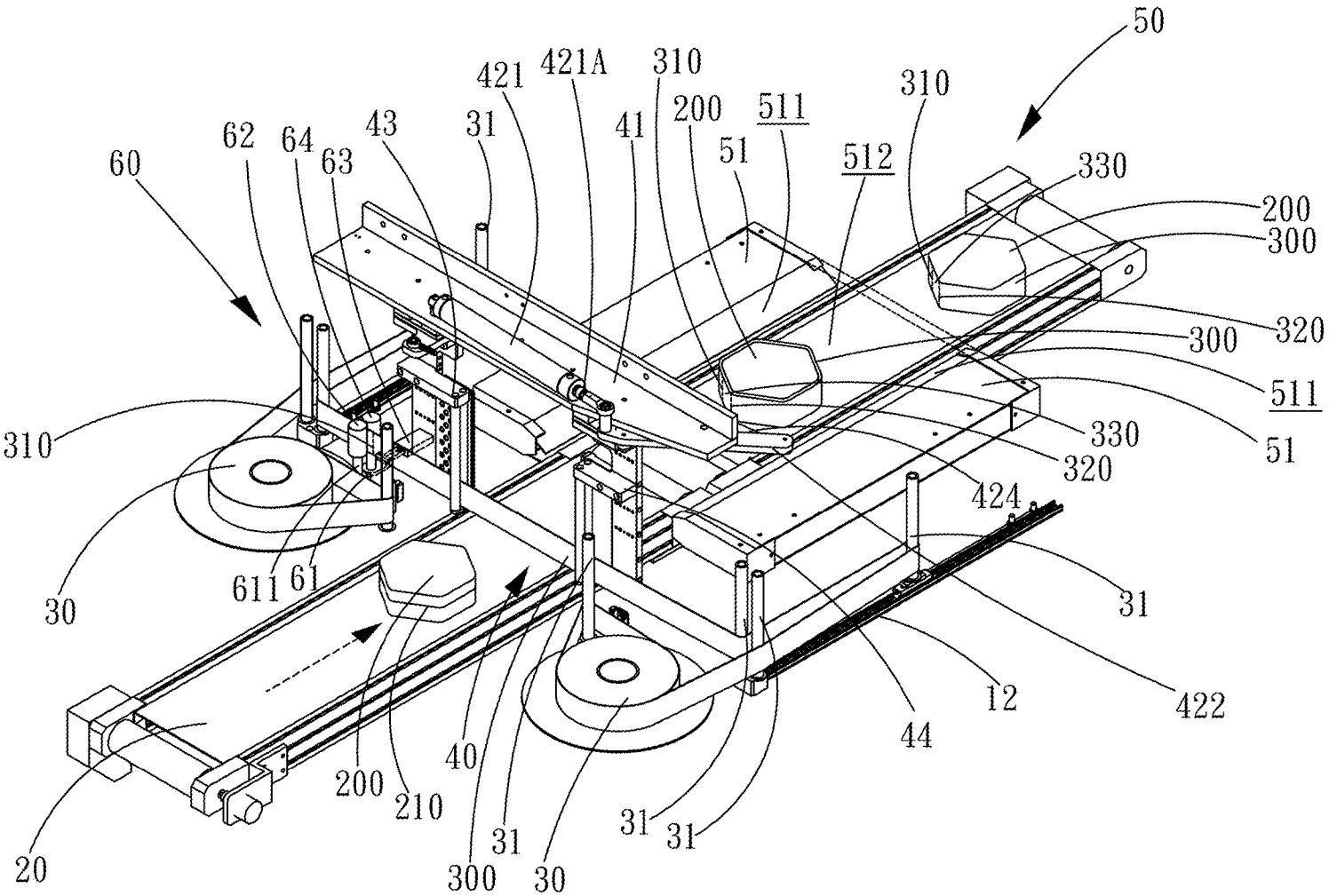
FIG. 10 is a partial enlarged view illustrating a condition where the plastic film sealing mechanism of the embodiment of FIG. 7 conducts sealing on the packaging plastic film wrapping around the articles-to-be-packaged to for a second sealing line.

Referring to FIGS. 7, 8, 9, 10, and 11, a second embodiment of the plastic film sealing and packaging device 100 according to the present invention is shown, wherein an article-to-be-packaged 200 is shown to be a polygonal meal box including a cover. At least one plastic film sealing line shifting device 60 is provided at a location behind the plastic film conveyance tray 30 on at least one side of the chassis 10 to provide a function of pulling the packaging plastic film 300, which has been subjected to sealing and combining by the plastic film sealing mechanism 40 and is set horizontally on the forward path of the conveyance device 20, outward for a predetermined distance. The plastic film sealing line shifting device 60 is not limited to any specific type and comprises, as an example in the present invention, at least one drive motor 61, a front retention roller 62, a pushing pneumatic cylinder 63, and a rear retention roller 64, wherein the drive motor 61 is mounted on the chassis 10 at a location in front of the packaging plastic film 300. The front retention roller 62 is coupled to a rotation spindle 611 of the drive motor 61 to be driven to rotate by the drive motor 61. The front retention roller 62 is set in contact with a front surface of the packaging plastic film 300. The pushing pneumatic cylinder 63 is mounted on the chassis 10 at a location behind the packaging plastic film 300. The pushing pneumatic cylinder 63 has an operation rod 631 coupled to the rear retention roller 64, so that the operation rod 631 of the pushing pneumatic cylinder 63 may move the rear retention roller 64 forward to contact with the front retention roller 62 and respectively clamp front and rear surfaces of the packaging plastic film 300. The drive motor 61 is operated to rotate and drive the front retention roller 62 to rotate and thus drive the packaging plastic film 300 to be pulled outward, as a backward returning movement, by a predetermined distance (as shown in FIG. 9), and also pulling the first sealing line 310 of the packaging plastic film 300 outward by a predetermined distance. After the packaging plastic film 300 and the first sealing line 310 have been pulled outward and backward, the operation rod 631 of the pushing pneumatic cylinder 63 retracts to move the rear retention roller 64 back to the original location. The plastic film sealing line shifting device 60 is also controlled by the controller 13 mounted on the chassis 10 to carry out the operation of pulling the first sealing line 310 of the packaging plastic film 300 outward and the distance of pulling.

When the location of the first sealing line 310 of the packaging plastic film 300 has been outward shifted a predetermined distance by the plastic film sealing line shifting device 60, the article-to-be-packaged 200 that is conveyed forward by the conveyance device 20 is allowed to get contact with the combined strap-like packaging plastic film 300 that is horizontally set on the forward path of the conveyance device 20 to wrap around the closure site 210 of the article-to-be-packaged 200 and then, the plastic film sealing mechanism 40 is operated to provide sealing, fixing, and cutting operations to the packaging plastic film 300 of the articles-to-be-packaged 200, making the packaging plastic film 300 fixedly wrapping around the closure site 210 of the articles-to-be-packaged 200 and forming a second sealing line 320 on the packaging plastic film 300, where the angular position of the second sealing line 320 with respect to the first sealing line 310 is less than 180 degrees. In addition, the portion of the packaging plastic film 300 between the second sealing line 320 and the first sealing line 310 may form a breakable and tearable block 330. The spacing distance between the second sealing line 320 and the first sealing line 310 and a surface area of the breakable and tearable block 330 (as shown in FIG. 11) are determined by the distance that the packaging plastic film 300 and the first sealing line 310 are pulled outwards and backward by the plastic film sealing line shifting device 60.

Figure 11:
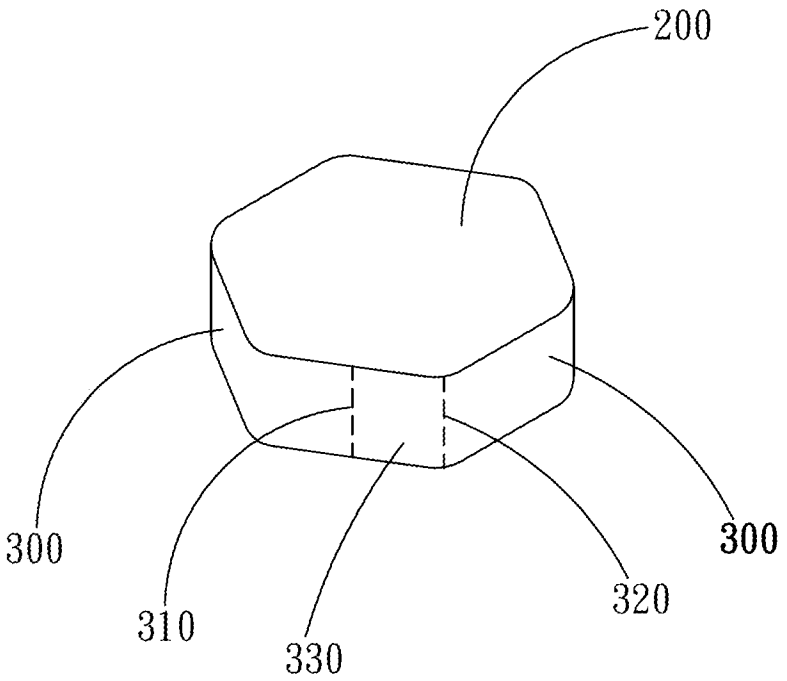
FIG. 11 is a schematic view showing, in the embodiment of FIG. 7, an article-to-be-packaged is completely packaged and sealed with the packaging plastic films.
Figure 12:
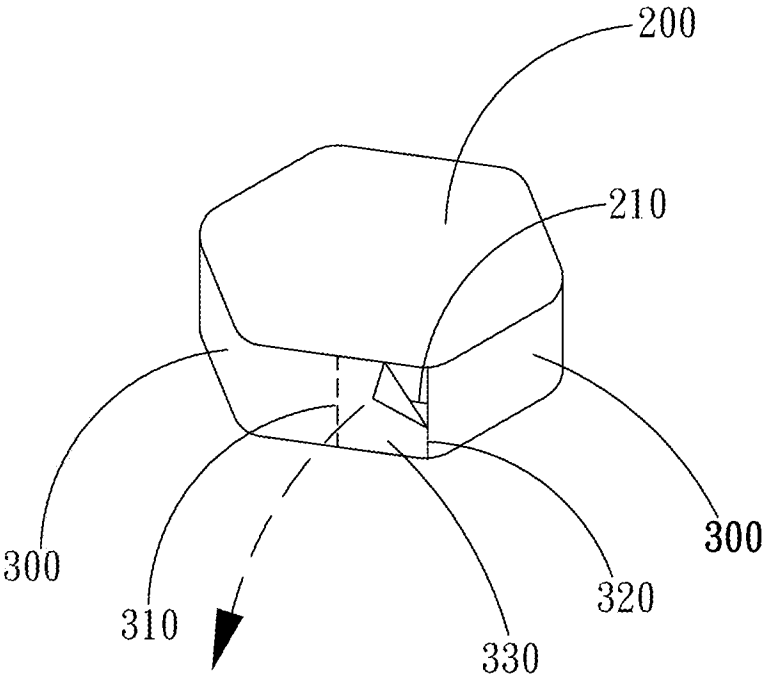
FIG. 12 is a schematic view showing a breakable and tearable block formed on the packaging plastic film of the article-to-be-packaged being torn away to remove the packaging plastic film.

Referring to FIG. 12, the article-to-be-packaged 200 that has been fixedly wrapped around by the packaging plastic film 300 at the closure site 210 thereof as shown in FIG. 11 is then subjected to heating and heat-shrinking by the heat-shrinking devices 50 to form a final packaged product. When a user intends to remove the packaging plastic film 300 from the packaged article 200, the user may use the breakable and tearable block 330 formed between the first sealing line 310 and the second sealing line 320 to pull down and tear (as indicated by the arrow shown in FIG. 12) to have the packaging plastic film 300 efficiently and completely removed from the packaged article 200, and no additional tool is necessary or no imprinted perforation line provided on the packaging plastic film 300 is needed.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A plastic film sealing and packaging device, comprising:

a chassis;

at least one conveyance device arranged in and extending through front and rear ends of the chassis for conveying a plurality of articles-to-be-packaged;

at least one pair of plastic film conveyance trays respectively set at two sides of the conveyance device, the plastic film conveyance trays each receiving a strap-like packaging plastic film wrapped thereon in order to supply, in a direction from outside to inside, the strap-like packaging plastic film;

at least one plastic film sealing mechanism arranged rearward relative to the plastic film conveyance trays to seal and combine the strap-like packaging plastic films supplied from the plastic film conveyance trays as a combined packaging plastic film set horizontally across a forward path defined by the conveyance device and formed with a first sealing line, wherein one of the articles-to-be-packaged conveyed along the forward path by the conveyance device contacts the combined packaging plastic film horizontally set across the forward path for the combined packaging plastic film to wrap around a closure site of the article-to-be-packaged, the plastic film sealing mechanism being operable to provide sealing, fixing, and cutting operations on the strap-like packaging plastic films further supplied from the plastic film conveyance trays upon the combined packaging plastic film wrapping around the article-to-be-packaged to form a second sealing line thereon, the combined packaging plastic film being thereby fixedly wrapped around the closure site of the article-to-be-packaged; and at least one heat-shrinking device arranged rearward relative to the plastic film sealing mechanism operating on the combined packaging plastic film wrapped around the article-to-be-packaged for heating and shrink packaging, the combined packaging plastic film being thereby thermally shrunk onto the closure site of the articles-to-be-packaged;

at least one press-down and holding device coupled to the chassis disposed rearward relative to the plastic film sealing mechanism, the press-down and holding device including a holding section displaceable to press down and contact a top of the article-to-be-packaged when the plastic film sealing mechanism carries out a sealing operation on the packaging plastic film to form the second sealing line; and at least one plastic film sealing line shifting device arranged on at least one side of the conveyance device, the plastic film sealing line shifting device being activated to capture and displace the packaging plastic film by a predetermined distance between formations of the first and second sealing lines by the plastic film sealing mechanism.

2. The plastic film sealing and packaging device as claimed in claim 1, wherein the articles-to-be-packaged conveyed by the conveyance device are containers including covers.

3. The plastic film sealing and packaging device as claimed in claim 1, wherein the chassis is provided with a plurality of guide pillars disposed rearward relative to the plastic film conveyance trays to guide the packaging plastic films supplied from the plastic film conveyance trays to extend and wrap therearound.

4. The plastic film sealing and packaging device as claimed in claim 1, wherein the plastic film sealing mechanism includes:

at least one mounting plate mounted to the chassis, the mounting plate having at least one rail mounted to a bottom thereof and set horizontally;

at least one sealing drive device arranged between a top and the bottom of the mounting plate; and at least one pair of sealing blades having tops respectively mounted to the rail on the bottom of the mounting plate, the sealing blades being coupled to the sealing drive device, wherein the sealing blades are controlled and driven by the sealing drive device to move along a path of the rail for simultaneous movement inward toward each other for closing and thereby combining the packaging plastic films supplied from the plastic film conveyance trays and sealing, and to move outward along the path of the rail to return to an original position thereafter.

5. The plastic film sealing and packaging device as claimed in claim 4, wherein the sealing drive device of the plastic film sealing mechanism includes:

at least one driving pneumatic cylinder mounted to the top of the mounting plate, the driving pneumatic cylinder having an extendible/retractable operation rod;

at least one connection plate and a first connection bar, the connection plate having two ends respectively and pivotally connected to an end of the operation rod of the driving pneumatic cylinder and an end of the first connection bar, the connection plate being pivotally connected at a middle thereof with the bottom of the mounting plate, an opposite end of the first connection bar being pivotally connected to the top of one of the sealing blades for extension/retraction of the operation rod of the driving pneumatic cylinder and for the connection plate and the first connection bar to thereby drive the sealing blades to move inward toward each other or outward to the original position by following the path of the rail; and at least one second connection bar having two ends respectively connected to an opposite end of the connection plate and the top of another one of the sealing blades, the connection plate and the first connection bar thereby driving the second connection bar to extend/retract and drive the sealing blades to move inward toward each other or outward to the original position by following the path of the rail.

6. The plastic film sealing and packaging device as claimed in claim 1, wherein the first sealing line and the second sealing line formed by the plastic film sealing mechanism on the combined packaging plastic film wrapped around the article-to-be-packaged are set at locations thereon displaced angularly from each other by 180 degrees.

7. The plastic film sealing and packaging device as claimed in claim 1, wherein the chassis is provided with at least one press-down and holding device disposed rearward relative to the plastic film sealing mechanism, the press-down and holding device including an extendible/retractable operation rod, the operation rod having an end coupled to at least one pressing and holding section, wherein when the plastic film sealing mechanism carries out a sealing operation on the packaging plastic film to form the second sealing line, the operation rod extends downward to drive the pressing and holding section to press down and contact a top of the article-to-be-packaged.

8. The plastic film sealing and packaging device as claimed in claim 7, wherein the press-down and holding device includes a pneumatic cylinder.

9. The plastic film sealing and packaging device as claimed in claim 1, wherein the heat-shrinking device includes:

at least one pair of hot airflow supply devices respectively mounted on the chassis at locations corresponding to two sides of the conveyance device disposed rearward relative to the plastic film sealing mechanism, the hot airflow supply devices being each provided with an airflow outlet that supplies a hot airflow, the two hot airflow supply devices being provided therebetween with a heating passageway, the airflow outlets being arranged to face inward to supply the hot airflows to the heating passageway to carry out a heating and heat shrinking operation on the packaging plastic film wrapped around the article-to-be-packaged carried by the conveyance device; and at least one top cover mounted above the hot airflow supply devices to cover the heating passageway between the hot airflow supply devices.

10. The plastic film sealing and packaging device as claimed in claim 1, wherein the chassis is provided with a controller, which controls operations of the conveyance device, the plastic film sealing mechanism, and the heat-shrinking device.

11. A plastic film sealing and packaging device, comprising:

a chassis;

at least one conveyance device arranged in and extending through front and rear ends of the chassis for conveying a plurality of articles-to-be-packaged;

at least one pair of plastic film conveyance trays respectively set at two sides of the conveyance device, the plastic film conveyance trays each receiving a strap-like packaging plastic film wrapped thereon in order to supply, in a direction from outside to inside, the strap-like packaging plastic film;

at least one plastic film sealing line shifting device arranged on at least one side of the conveyance device to be disposed rearward relative to the plastic film conveyance trays, the plastic film sealing line shifting device being configured to selectively capture and pull the packaging plastic films by a predetermined distance;

at least one plastic film sealing mechanism arranged rearward relative to the plastic film conveyance trays to seal and combine the strap-like packaging plastic films supplied from the plastic film conveyance trays as a combined packaging plastic film set horizontally across a forward path defined by the conveyance device and formed with a first sealing line, wherein the plastic film sealing line shifting device is selectively driven to capture and pull the combined packaging plastic film outward and backward to displace the first sealing line relative to the conveyance device in position by a predetermined distance, and wherein one of the articles-to-be-packaged conveyed along the forward path by the conveyance device contacts the combined packaging plastic film horizontally set across the forward path for the combined packaging plastic film to wrap around a closure site of the article-to-be-packaged, the plastic film sealing mechanism being operable to provide sealing, fixing, and cutting operations on the strap-like packaging plastic films further supplied from the plastic film conveyance trays upon the combined packaging plastic film wrapping around the article-to-be-packaged to form a second sealing line thereon, the combined packaging plastic film being thereby fixedly wrapped around the closure site of the article-to-be-packaged, a breakable and tearable block being formed in the packaging plastic film between the second sealing line and the first sealing line; and at least one heat-shrinking device arranged rearward relative to the plastic film sealing mechanism operating on the combined packaging plastic film wrapped around the article-to-be-packaged for heating and shrink packaging, the combined packaging plastic film being thereby thermally shrunk onto the closure site of the articles-to-be-packaged.

12. The plastic film sealing and packaging device as claimed in claim 11, wherein the first sealing line and the second sealing line formed by the plastic film sealing mechanism on the combined packaging plastic film wrapped around the article-to-be-packaged are set at locations thereon displaced angularly from each other by 180 degrees.

13. The plastic film sealing and packaging device as claimed in claim 11, wherein the plastic film sealing line shifting device includes:

at least one drive motor and a front retention roller, the drive motor being arranged on the chassis in forward relative to the combined packaging plastic film horizontally set across the forward path, the front retention roller being coupled to a rotation spindle of the drive motor to be driven and rotated by the drive motor, the front retention roller being in contact with a front surface of the combined packaging plastic film; and at least one pushing pneumatic cylinder and a rear retention roller, the pushing pneumatic cylinder being arranged on the chassis rearward relative to the combined packaging plastic film, the pushing pneumatic cylinder having an operation rod coupled to the rear retention roller, the operation rod of the pushing pneumatic cylinder driving the rear retention roller to clamp the packaging plastic film against the front retention roller, the drive motor driving and rotating the front retention roller to rotate and pull the combined packaging plastic film outward and backward by a predetermined distance to displace the first sealing line of the combined packaging plastic film outward and backward by a predetermined distance relative to the conveyance device.

14. The plastic film sealing and packaging device as claimed in claim 11, wherein the heat-shrinking device includes:

at least one pair of hot airflow supply devices respectively mounted on the chassis at locations corresponding to two sides of the conveyance device rearward relative to the plastic film sealing mechanism, the hot airflow supply devices being each provided with an airflow outlet that supplies a hot airflow, the two hot airflow supply devices being provided therebetween with a heating passageway, the airflow outlets being arranged to face inward to supply the hot airflows to the heating passageway to carry out a heating and heat shrinking operation on the packaging plastic film wrapped around the article-to-be-packaged carried by the conveyance device; and at least one top cover mounted above the hot airflow supply devices to cover the heating passageway between the hot airflow supply devices.

15. The plastic film sealing and packaging device as claimed in claim 11, wherein the chassis is provided with a controller, which controls operations of the conveyance device, the plastic film sealing mechanism, and the heat-shrinking device.

* * * * *